US008042449B2

(12) United States Patent
Farinella et al.

(10) Patent No.: US 8,042,449 B2
(45) Date of Patent: Oct. 25, 2011

(54) VEHICLE PROTECTION SYSTEM

(75) Inventors: Michael D. Farinella, Belmont, MA (US); Thomas F. Hafer, Arlington, VA (US); Christopher Moeller, Nashua, NH (US); Loren Howard, Waban, MA (US); Scott LaValley, Marlborough, MA (US)

(73) Assignee: Foster-Miller, Inc., Waltham, MA (US)

( * ) Notice: Subject to any disclaimer, the term of this patent is extended or adjusted under 35 U.S.C. 154(b) by 0 days.

(21) Appl. No.: 12/806,724

(22) Filed: Aug. 19, 2010

(65) Prior Publication Data

US 2010/0319524 A1 Dec. 23, 2010

Related U.S. Application Data

(62) Division of application No. 11/351,130, filed on Feb. 9, 2006, now Pat. No. 7,866,250.

(51) Int. Cl.

| | |
|---|---|
| ***F41H 5/02*** | (2006.01) |
| ***F41H 13/00*** | (2006.01) |
| ***B64D 7/00*** | (2006.01) |
| ***B63G 9/04*** | (2006.01) |
| *F41H 3/02* | (2006.01) |

(52) U.S. Cl. ..... 89/36.01; 89/36.04; 89/36.07; 89/36.08; 89/36.09; 89/36.11; 89/36.12; 89/36.15; 89/36.17; 89/916; 114/241

(58) Field of Classification Search ..... 89/36.01, 89/36.04, 36.07, 36.08, 36.09, 36.11, 36.12, 89/36.15, 36.17; 114/241; 296/187.07; 43/7, 43/9.8, 9.95; 87/12

See application file for complete search history.

(56) References Cited

U.S. PATENT DOCUMENTS

| | | | | |
|---|---|---|---|---|
| 1,198,035 | A | | 9/1916 | Huntington |
| 1,204,547 | A | * | 11/1916 | Corrado et al. ..... 114/241 |
| 1,229,421 | A | | 6/1917 | Downs |
| 1,235,076 | A | | 7/1917 | Stanton |
| 1,385,897 | A | | 7/1921 | Tresidder |
| 2,296,980 | A | | 9/1942 | Carmichael |
| 2,308,683 | A | | 1/1943 | Forbes |
| 2,322,624 | A | | 6/1943 | Forbes |
| 3,129,632 | A | * | 4/1964 | Starr ..... 87/12 |
| 3,633,936 | A | | 1/1972 | Huber |
| 3,656,791 | A | | 4/1972 | Truesdell |
| 3,893,368 | A | | 7/1975 | Wales, Jr. |
| 3,992,628 | A | | 11/1976 | Karney |
| 4,253,132 | A | | 2/1981 | Cover |

(Continued)

FOREIGN PATENT DOCUMENTS

| | | |
|---|---|---|
| DE | 2206404 | 8/1973 |

(Continued)

OTHER PUBLICATIONS

International Search Report and Written Opinion, dated Jan. 7, 2010, for International Application No. PCT/US2009/002363, 8 pages, unnumbered.

(Continued)

*Primary Examiner* — Bret Hayes
(74) *Attorney, Agent, or Firm* — Iandiorio Teska & Coleman

(57) ABSTRACT

A structure or vehicle protection system including a removable frame on the structure or vehicle, and a net within the frame and spaced from the structure or vehicle and having a mesh size designed to disarm an incoming threat.

9 Claims, 15 Drawing Sheets

U.S. PATENT DOCUMENTS

| | | | | |
|---|---|---|---|---|
| 4,262,595 | A | | 4/1981 | Longerich |
| 4,358,984 | A | * | 11/1982 | Winblad ..... 89/36.08 |
| 4,768,417 | A | | 9/1988 | Wright |
| 4,912,869 | A | | 4/1990 | Govett |
| 4,928,575 | A | | 5/1990 | Smirlock et al. |
| 5,007,326 | A | | 4/1991 | Gooch, Jr. et al. |
| 5,025,707 | A | | 6/1991 | Gonzalez |
| 5,069,109 | A | | 12/1991 | Lavan, Jr. |
| 5,078,117 | A | | 1/1992 | Cover |
| 5,094,170 | A | | 3/1992 | Raynaud et al. |
| 5,170,690 | A | | 12/1992 | Smirlock et al. |
| 5,191,166 | A | | 3/1993 | Smirlock et al. |
| 5,279,199 | A | | 1/1994 | August |
| 5,333,532 | A | | 8/1994 | Smirlock et al. |
| 5,370,035 | A | | 12/1994 | Madden, Jr. |
| 5,394,786 | A | | 3/1995 | Gettle et al. |
| 5,400,688 | A | | 3/1995 | Eninger et al. |
| 5,435,226 | A | | 7/1995 | McQuilkin |
| 5,524,524 | A | | 6/1996 | Richards et al. |
| 5,578,784 | A | | 11/1996 | Karr et al. |
| 5,583,311 | A | | 12/1996 | Rieger |
| 5,622,455 | A | | 4/1997 | Anderson et al. |
| 5,646,613 | A | | 7/1997 | Cho |
| 5,725,265 | A | | 3/1998 | Baber |
| 5,739,458 | A | | 4/1998 | Girard |
| 5,750,918 | A | | 5/1998 | Mangolds et al. |
| 5,792,976 | A | | 8/1998 | Genovese |
| 5,898,125 | A | | 4/1999 | Mangolds et al. |
| 5,924,723 | A | | 7/1999 | Brantman et al. |
| 5,988,036 | A | | 11/1999 | Mangolds et al. |
| 6,029,558 | A | | 2/2000 | Stevens et al. |
| 6,119,574 | A | | 9/2000 | Burkey et al. |
| 6,128,999 | A | | 10/2000 | Sepp et al. |
| 6,279,449 | B1 | | 8/2001 | Ladika et al. |
| 6,282,860 | B1 | | 9/2001 | Ramirez |
| 6,311,605 | B1 | | 11/2001 | Kellner et al. |
| 6,325,015 | B1 | | 12/2001 | Garcia et al. |
| 6,374,565 | B1 | | 4/2002 | Warren |
| 6,394,016 | B2 | | 5/2002 | Swartout et al. |
| 6,595,102 | B2 | | 7/2003 | Stevens et al. |
| 6,626,077 | B1 | | 9/2003 | Gilbert |
| 6,672,220 | B2 | | 1/2004 | Brooks et al. |
| 6,782,792 | B1 | | 8/2004 | Edberg et al. |
| 6,805,035 | B2 | | 10/2004 | Edberg et al. |
| 6,854,374 | B1 | | 2/2005 | Breazeale |
| 6,901,839 | B2 | | 6/2005 | Edberg et al. |
| 6,904,838 | B1 | | 6/2005 | Dindl |
| 6,925,771 | B2 | | 8/2005 | Lee et al. |
| 6,957,602 | B1 | | 10/2005 | Koenig et al. |
| 7,190,304 | B1 | | 3/2007 | Carlson |
| 7,308,738 | B2 | | 12/2007 | Barvosa-Carter et al. |
| 7,328,644 | B2 | | 2/2008 | Vickroy |
| 7,412,916 | B2 | | 8/2008 | Lloyd |
| 7,415,917 | B2 | | 8/2008 | Lloyd |
| 7,513,186 | B2 | | 4/2009 | Ravid et al. |
| 2001/0032577 | A1 | | 10/2001 | Swartout et al. |
| 2002/0134365 | A1 | | 9/2002 | Gray |
| 2003/0217502 | A1 | | 11/2003 | Hansen |
| 2004/0016846 | A1 | | 1/2004 | Blackwell-Thompson et al. |
| 2005/0011396 | A1 | | 1/2005 | Burdette et al. |
| 2005/0016372 | A1 | | 1/2005 | Kilvert |
| 2005/0278098 | A1 | | 12/2005 | Breed |
| 2006/0065111 | A1 | | 3/2006 | Henry |
| 2007/0057495 | A1 | | 3/2007 | Tesch et al. |
| 2007/0089597 | A1 | | 4/2007 | Ma |
| 2007/0180983 | A1 | | 8/2007 | Farinella et al. |
| 2008/0164379 | A1 | | 7/2008 | Wartmann et al. |
| 2008/0258063 | A1 | | 10/2008 | Rapanotti |
| 2009/0084284 | A1 | | 4/2009 | Martinez et al. |
| 2009/0104422 | A1 | | 4/2009 | Sampson |
| 2009/0173250 | A1 | | 7/2009 | Marscher et al. |
| 2009/0178597 | A1 | | 7/2009 | Sliwa, Jr. |
| 2009/0217811 | A1 | | 9/2009 | Leeming |
| 2009/0266226 | A1 | | 10/2009 | Beach et al. |

FOREIGN PATENT DOCUMENTS

| | | | |
|---|---|---|---|
| DE | 3722420 | C2 | 1/1989 |
| DE | 3735426 | A1 | 5/1989 |
| DE | 3834367 | A1 | 4/1990 |
| DE | 4437412 | A1 | 9/1995 |
| DE | 691067 | | 1/2006 |
| EP | 0655603 | A1 | 5/1995 |
| EP | 0872705 | B1 | 4/1998 |
| EP | 0902250 | B1 | 9/1998 |
| FR | 2695467 | A1 | 3/1994 |
| GB | 2449055 | A | 11/2008 |
| WO | WO 99/30966 | | 6/1999 |
| WO | WO 2006/134407 | A1 | 12/2006 |
| WO | WO 2006/135432 | A2 | 12/2006 |
| WO | WO 2008/070001 | A1 | 1/2008 |
| WO | WO 2008/079001 | | 3/2008 |

OTHER PUBLICATIONS

File history of U.S. Published Patent Application No. 2008/0164379, published Jul. 10, 2008, 304 pgs.

* cited by examiner

VEHICLE PROTECTION SYSTEM

RELATED APPLICATIONS

This application is a divisional application which claims the benefit of and priority to U.S. patent application Ser. No. 11/351,130 filed Feb. 9, 2006, now U.S. Pat. No. 7,866,250 under 35 U.S.C. §§119, 120, 363, 365, and 37 C.F.R. §1.55 and §1.78 which is incorporated into this application by reference.

GOVERNMENT RIGHTS

This invention was made with U.S. Government support under DARPA contract No. HR0011-05-C-0056. The Government may have certain rights in the subject invention.

FIELD OF THE INVENTION

This subject invention relates to counter measure systems and, in particular, to an easy to install, fairly inexpensive, and more effective vehicle protection system.

BACKGROUND OF THE INVENTION

Rocket Propelled Grenades (RPGs) and other threats used by enemy forces and insurgents are a serious threat to troops on the battlefield, on city streets, and on country roads. RPG weapons are relatively inexpensive and widely available throughout the world. There are variety of RPG warhead types, but the most prolific are the RPG-7 and RPG-7M which employ a focus blast or shaped charge warhead capable of penetrating considerable armor even if the warhead is detonated at standoffs up to 10 meters from a vehicle. A perfect hit with a shaped charge can penetrate a 12 inch thick steel plate. RPG's pose a persistent deadly threat to moving ground vehicles and stationary structures such as security check points.

Heavily armored, lightly armored, and unarmored vehicles have been proven vulnerable to the RPG shaped charge. Pick-up trucks, HMMWV's, 2½ ton trucks, 5 ton trucks, light armor vehicles, and M118 armored personnel carriers are frequently defeated by a single RPG shot. Even heavily armored vehicles such as the M1 Abrams Tank have been felled by a single RPG shot. The RPG-7 and RPG-7M are the most prolific class of RPG weapons, accounting for a reported 90% of the engagements. RPG-18s have been reported as well accounting for a significant remainder of the threat encounters. Close engagements 30 meters away occurs in less than 0.25 seconds and an impact speed ranging from 120-180 m/s. Engagements at 100 meters will reach a target in approximately 1.0 second and at impact speeds approaching 300 m/s.

The RPG-7 is in general use in Africa, Asia, and the Middle East and weapon caches are found in random locations making them available to the inexperienced insurgent. Today, the RPG threat in Iraq is present at every turn and caches have been found under bridges, in pickup trucks, buried by the road sides, and in even in churches.

Armor plating on a vehicle does not always protect the vehicle's occupants in the case of an RPG impact and no known countermeasure has proven effective.

Certain prior art discloses the idea of deploying an airbag (U.S. Pat No. 6,029,558) or a barrier (U.S. Pat. No. 6,279,449) in the trajectory path of a munition to deflect it but such countermeasure systems would be wholly ineffective in the face of a RPG.

Other prior art discloses systems designed to intercept and destroy an incoming threat. See, e.g., U.S. Pat. No. 5,578,784 which discloses a projectile "catcher" launched into the path of a projectile. Many such interception systems are ineffective and/or expensive, complex, and unreliable.

SUMMARY OF THE INVENTION

It is therefore an object of this invention to provide a more effective and reliable protection system for vehicles and structures.

It is a further object of this invention to provide such a system which is fairly simple in design, easy to install and remove, and which is inexpensive.

The subject invention results from the realization that a more effective and reliable protection system is effected by a shield typically deployable outward from a vehicle or structure when an incoming RPG or other threat is detected and designed to disarm the threat instead of deflect or intercept and destroy the threat.

The subject invention, however, in other embodiments, need not achieve all these objectives and the claims hereof should not be limited to structures or methods capable of achieving these objectives.

This invention features a protection system for a vehicle or other structure. In one embodiment, there is a sensor subsystem for detecting an incoming threat, a flexible packaged net with perimeter weighting housed in a deployment box attached to the vehicle, a deployment subsystem including an airbag packaged in the deployment box behind the net, and a fire control subsystem, responsive to the sensor subsystem, configured to activate the deployment subsystem to inflate the airbag and deploy the net in the trajectory path of the incoming threat.

In one example, the sensor subsystem includes a radar system. Preferably, the threat has a nose diameter less than its body diameter and the net has a mesh size between the body diameter and the tail diameter, typically between 30-60 mm. Preferably, the net has a knotless weave. The net can be made of PBO material and may have a line diameter of 0.5-3 mm.

Typically, the airbag is mounted centrally in the box, the perimeter weighting is located over the airbag, and the remainder of the net is folded adjacent the sides of the airbag. The deployment box then defines a concave compartment for the remainder of the net around the airbag.

The net may be attached to the deployment box or not. There may be two or more nets packaged in the deployment box with their mesh aligned or not depending on the specific implementation. The preferred net may include at least one layer of smaller diameter line material and a layer of larger diameter line material. Typically, there are between 2-4 layers of smaller diameter line material over a single layer of larger diameter line material.

One protection system in accordance with this invention includes a sensor subsystem for detecting an incoming threat, a flexible packaged net in a deployment box attached to a structure, a deployment subsystem packaged in the deployment box, and a fire control subsystem, responsive to the sensor system, configured to activate the deployment system to deploy the net into the trajectory path of the incoming threat. One example of a deployment subsystem is an airbag packaged in the deployment box behind the net. The fire control subsystem is configured to activate the deployment subsystem to inflate the airbag and deploy the net. Another example of a deployment subsystem includes rockets attached to the net. The fire control subsystem is configured to fire the rocket to deploy the net. Another deployment subsystem includes spring loaded folded actuators configured to deploy the net as the actuators are released.

In another embodiment, the protection system includes a frame on a structure and a net on the frame spaced from the structure and having a mesh size designed to disarm an incoming threat. Typically, the net mesh size is between 35-60 mm. The preferred net has a knotless "ultracross" weave. There may be two or more nets on the frame with their mesh aligned or not.

A protection system in accordance with this invention may be characterized as including, inter alia, flexible means for disarming an incoming threat and means for deploying said flexible means into a spaced relationship with a structure. In the preferred embodiment, the flexible means includes a net. In one example, the means for deploying includes an airbag. In another example, the means for deploying includes rockets. In still another example, the means for deploying is a static frame attached to the structure.

In a more comprehensive sense, one protection system in accordance with this invention features a mobile vehicle including sensor subsystem for detecting an incoming threat. A deployment box is removably attached to the vehicle. The deployment box includes therein a flexible packaged net with perimeter weighting, and a deployment subsystem including an airbag is packaged in the deployment box behind the net. A fire control subsystem is responsive to the sensor subsystem and is configured to activate the deployment subsystem to inflate the airbag and deploy the net in the trajectory path of the incoming threat.

Another protection system for a threat having a nose diameter less than its body diameter includes a mobile vehicle with a frame releasably attached to the vehicle. A net on the frame is spaced from the vehicle and has a mesh size between the threat nose diameter and the body diameter to disarm the threat.

One preferred protection system includes a flexible packaged net including at least two layers of a small line diameter net over at least one layer of a larger line diameter net and a deployment subsystem for deploying the net. One deployment subsystem includes an airbag. Another deployment subsystem includes rockets. Still another deployment subsystem includes a static frame for the net. Still another deployment subsystem includes actuator members.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
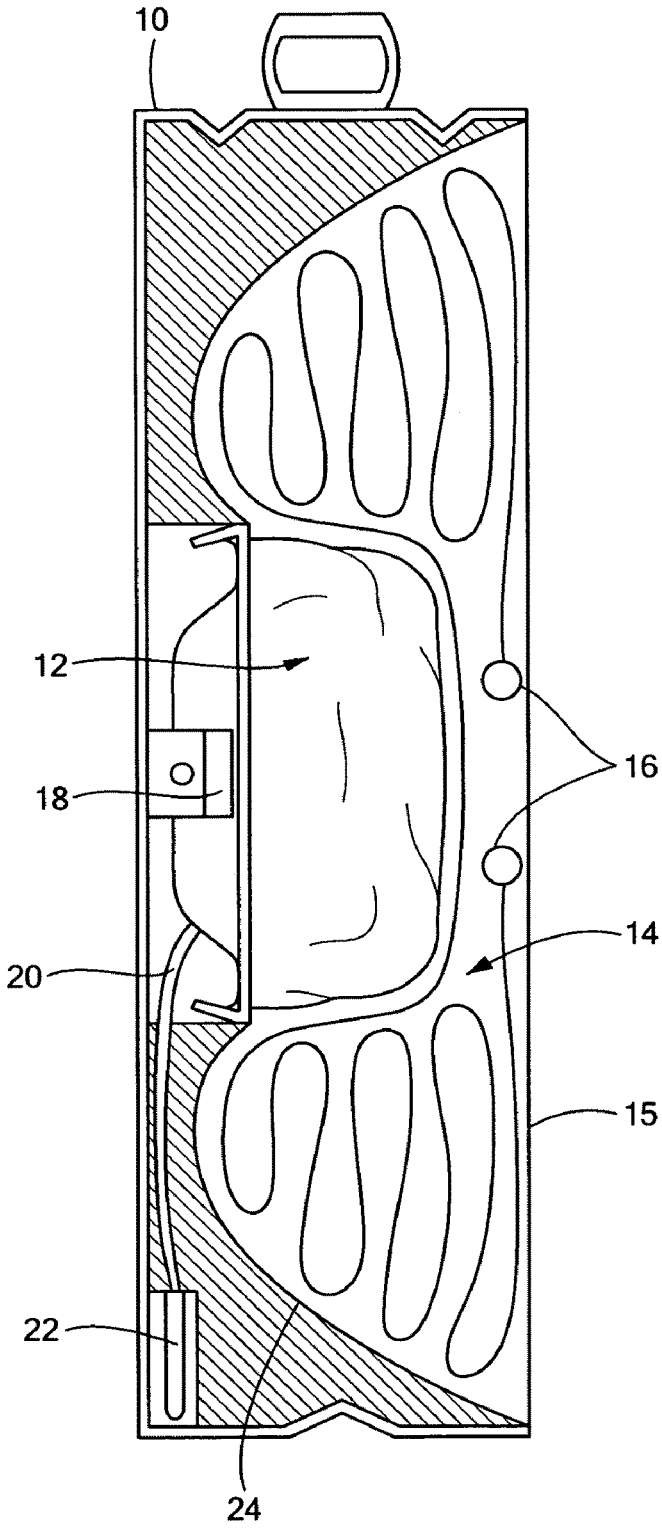
FIG. 1 is a schematic cross-sectional side view of one embodiment of a protection system in accordance with the subject invention featuring a flexible packaged net deployed by an airbag.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

In one specific embodiment, a vehicle or structure protection system in accordance with the subject invention includes 4" deep, 14½"×14", 35 lb deployment box 10, FIG. 1 releasably attached to the exterior of vehicle or other structure in any desired location. In this way, the protection system of this invention can be used as desired on any vehicle configuration and in any location on the vehicle. Box 10 houses airbag 12 and flexible means such as net 14 with perimeter weights 16 and/or a weighted perimeter line. Airbag 12 is inflated via gas generator 18 in a manner known to those skilled in the art via a signal on line 20 connected to electric trigger connector 22. Airbag 12 is typically centrally mounted as shown and the net perimeter and perimeter weights 16 are located over the airbag with the remainder of the net folded in the concave compartment 24 about airbag 12. Front covering 15 retains net 14 in aluminum box 10 until net 14 is deployed. Front covering 15 may be a thin plastic film or in the form of two hinged doors which open upon net deployment.

Figure 2:
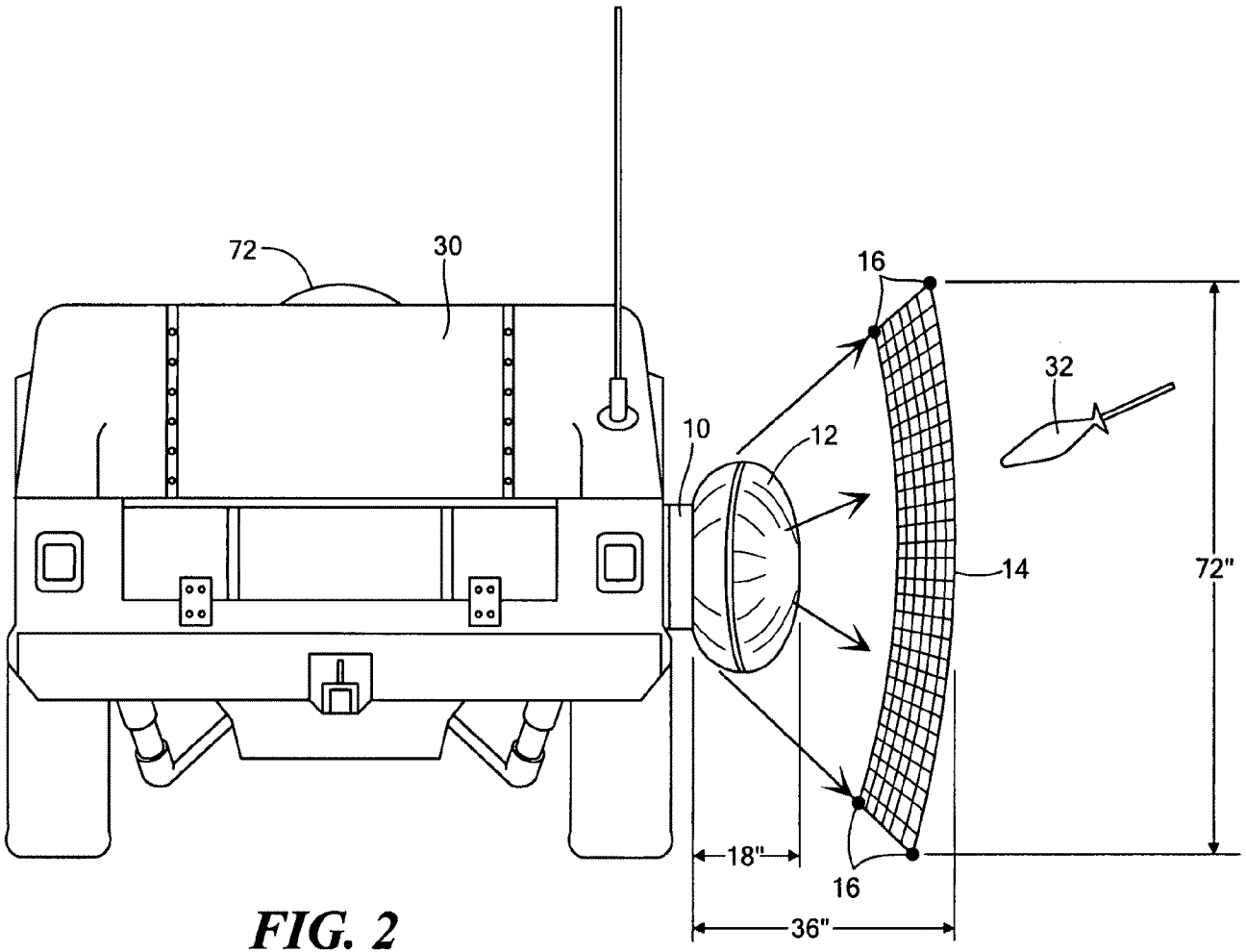
FIG. 2 is a schematic three-dimensional rear view showing an example of the airbag inflated and the net deployed.
Figure 3:
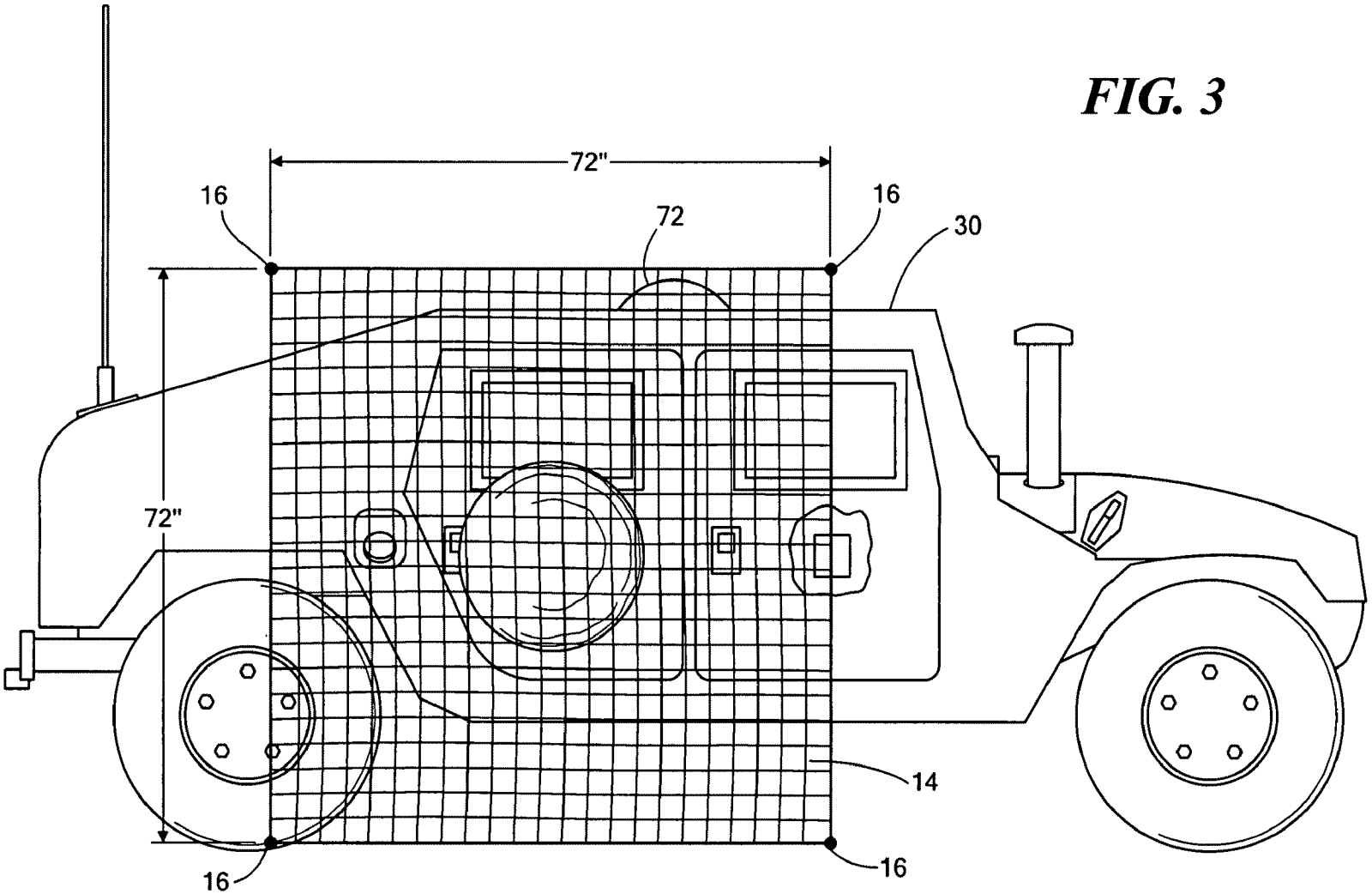
FIG. 3 is a schematic side view of the inflated airbag and the net shown in FIG. 2.

FIGS. 2-3 show deployment box 10 mounted to a door panel of military vehicle 30 via straps and/or hook and loop fasteners and airbag 12 inflated and net 14 deployed to its full extent (e.g., 72" long by 72" wide) 36" from vehicle 30 in the trajectory path of threat 32, e.g., an RPG.

Figure 4:
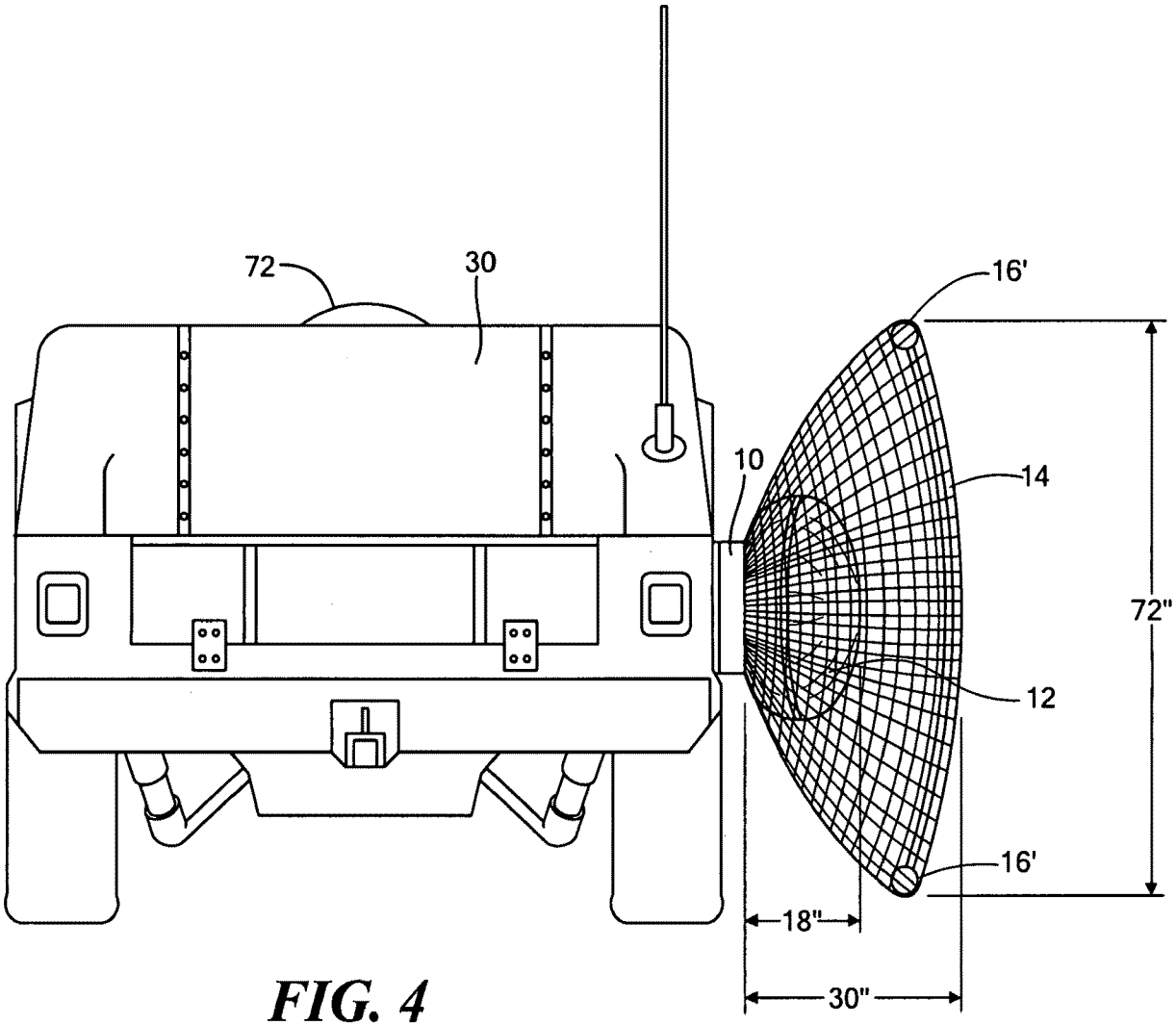
FIG. 4 is another schematic three-dimensional rear view similar to FIG. 2 except now the net remains attached to a deployment box affixed to the vehicle.

In this embodiment, net 14 is not attached to deployment box 10. FIG. 4 shows an embodiment where net 14' is attached to deployment box 10 as does the embodiment shown and discussed below with respect to FIG. 10.

In any embodiment, the deployment box can be attached to all the door panels of vehicle 30, its roof, its hood, its front and rear bumpers, and the like to provide complete vehicle coverage.

Figure 5:
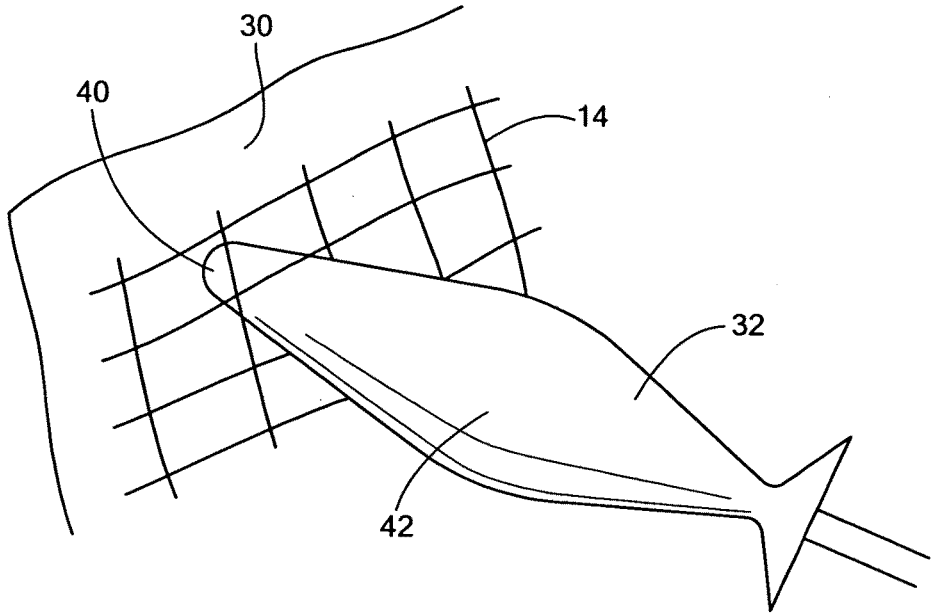
FIG. 5 is a schematic three-dimensional view showing in more detail how the flexible net of FIGS. 1-4 disables an RPG in accordance with subject invention.
Figure 6:
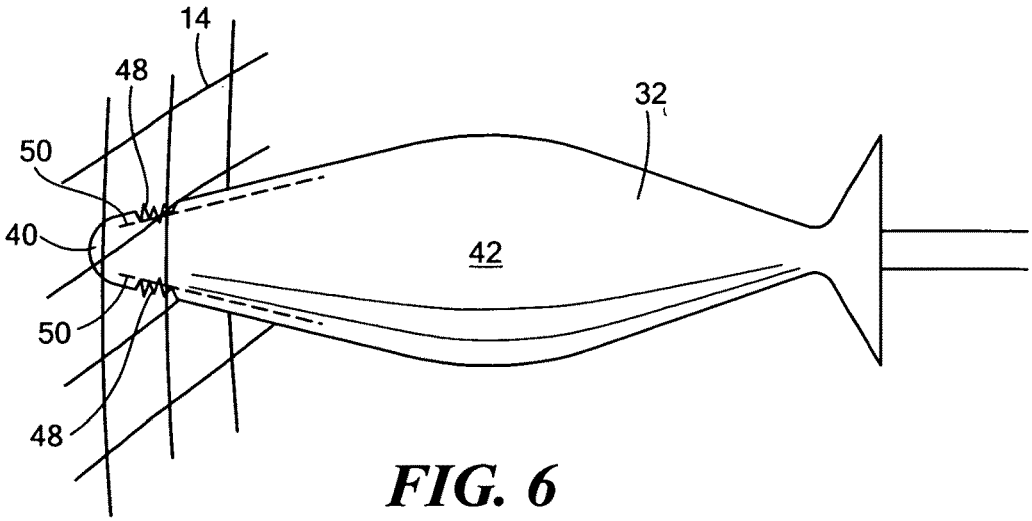
FIG. 6 is a schematic highly conceptual side view of the RPG being damaged by the net shown in FIG. 5.

As discussed above, net 14, FIG. 5 functions to disarm threat 32 rather than to deflect or destroy it. Threat 32 has a nose 40 with a diameter less than body portion 42 and the mesh size of net 14 (typically 30-60 mm) is preferably tailored to capture threat 32 and in so doing destroy, as shown at 48, the impact fusing 50, FIG. 6 running just under the skin of threat 32 so that when nose 40 strikes a target, the threat has now been disarmed and the impact will not trigger detonation of the RPG explosive. The ultralight net barrier collapses the RPG ogive, shorts its fuse, and duds the round.

The preferred net has a knotless weave for increased strength (e.g., an "ultracross" weave) and is made of "Dyneema" or PBO (poly P-phenylene-2,6 bezibisoxazole) material with a line diameter of between 0.5 mm to 3 mm. The net material, construction, and line diameter may vary depending upon the specific implementation, its location on the vehicle or structure, the vehicle or structure type, and the different types of threats likely to be encountered. "Net" as used herein, means not only traditional nets but also scrims, fabrics with loose weaves, and other structures designed to disarm incoming threats.

Figure 7:
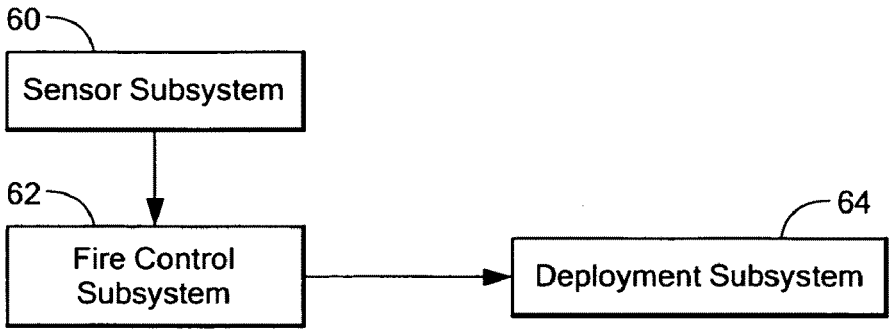
FIG. 7 is a schematic block diagram depicting the primary subsystems associated with a typical protection system in accordance with the subject invention.
Figure 8:
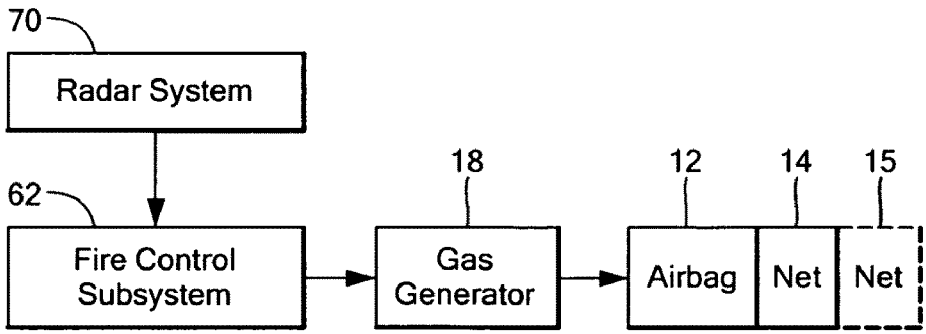
FIG. 8 is a block diagram showing the primary components associated with the vehicle protection system shown in FIGS. 1-4.

A complete system in accordance with one example of the subject invention also includes a sensor subsystem 60, FIG. 7. In the example shown in FIGS. 2-4, the sensor subsystem includes radar system 70, FIG. 8 with antenna 72, FIGS. 2-4. Deployment subsystem 64, FIG. 7 is activated by fire control subsystem 62 which receives a signal from sensor subsystem 60 indicating the presence of an incoming threat. In the example of FIGS. 2-4, active deployment subsystem 64, FIG. 7 includes gas generator 18 triggered by fire control system 62 to inflate airbag 12 via connector 22, FIG. 1. The deployed disarming shield subsystem includes airbag 12, net 14, and optionally additional nets such as net 15 shown in phantom. The mesh of these multiple nets may be aligned or overlapping as desired when packaged in the deployment box and when deployed. Preferably, the layers or plies of net material do not have their openings aligned.

Those skilled in the art will appreciate that sensor subsystem 60, FIG. 7 is not limited to radar based techniques. U.S. Pat. Nos. 6,279,449 and 6,029,558, incorporated herein by this reference, disclose Doppler radar systems but acoustic or optical based sensors (see U.S. Pat. No. 5,578,784 also incorporated herein by this reference) and other sensor subsystems are possible in connection with the subject invention. Various fire control circuitry and threat size and characterization systems are also well known. Also, means other than an airbag used to deploy the net are also possible in connection with the subject invention as discussed below. Moreover, the system of this invention is intended to work in combination with structures other than vehicles including check point stations, bunkers, and other shelters.

Figure 9:
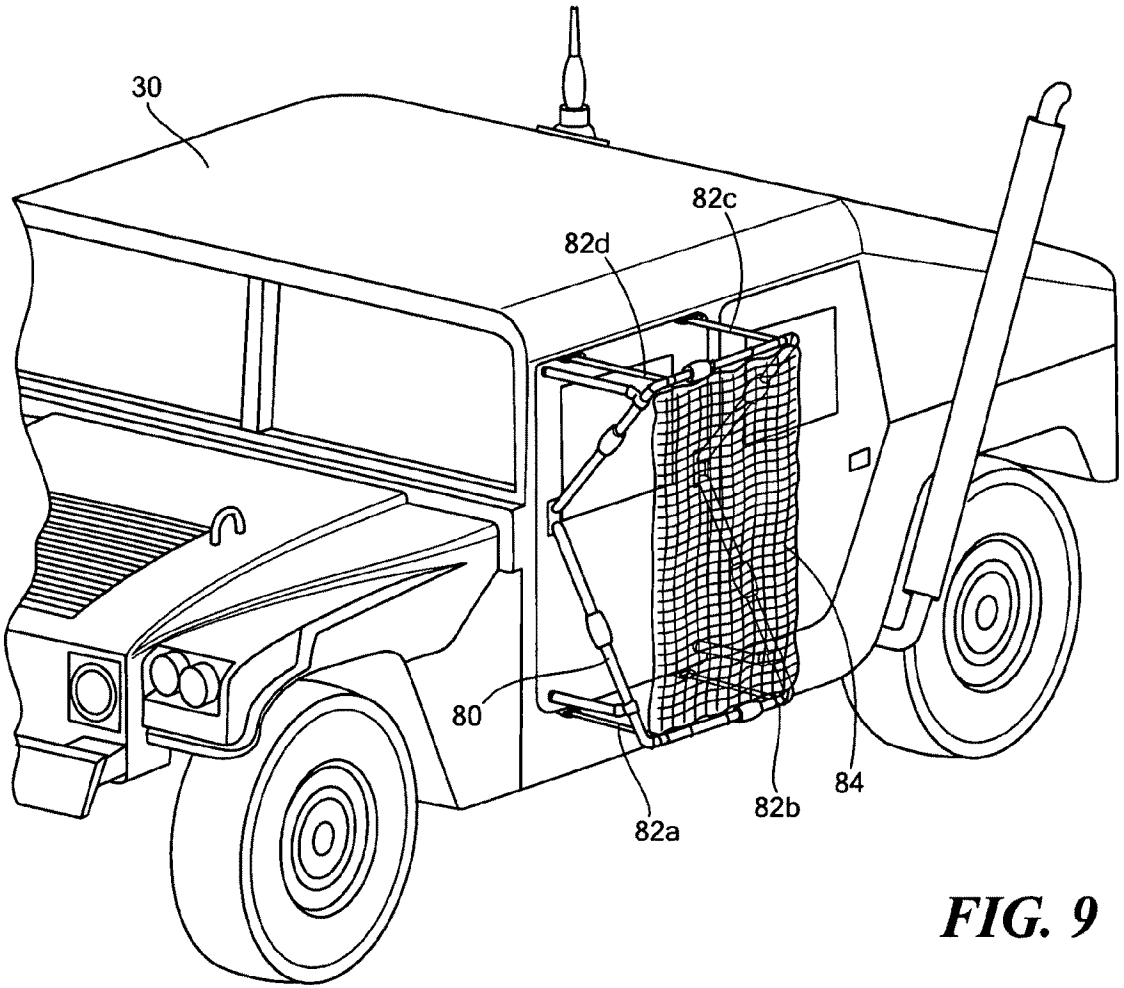
FIG. 9 is a schematic three-dimensional side view showing another embodiment of a protection system in accordance with the subject invention.

FIG. 9 shows another embodiment of the subject invention wherein removable static deployment frame 80 is attached to military vehicle 30 via straps 82*a*-82*d* supporting shield 84 in a spaced relation to vehicle 30, typically between 8"-48". As with the embodiment described above, shield 84 is configured to disarm an incoming threat as discussed with reference to FIGS. 5-6. In one preferred example, shield 84 is a net as described above. The frame and net combination may be conveniently mounted on the sides of vehicle 30, on its hood, on its roof, and also on the rear of vehicle 30.

Figure 10A:
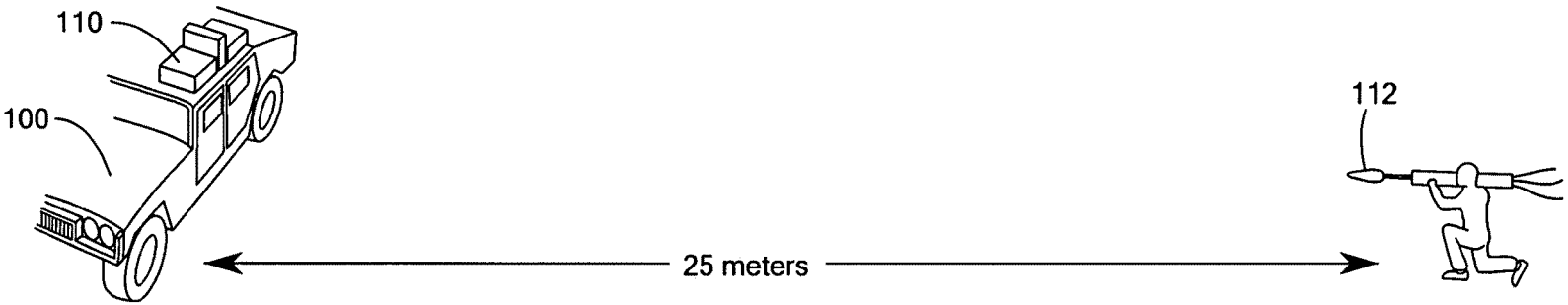
FIGS. 10A-10E are highly schematic three-dimensional views showing still another embodiment of a protection system in accordance with the subject invention.
Figure 10B:
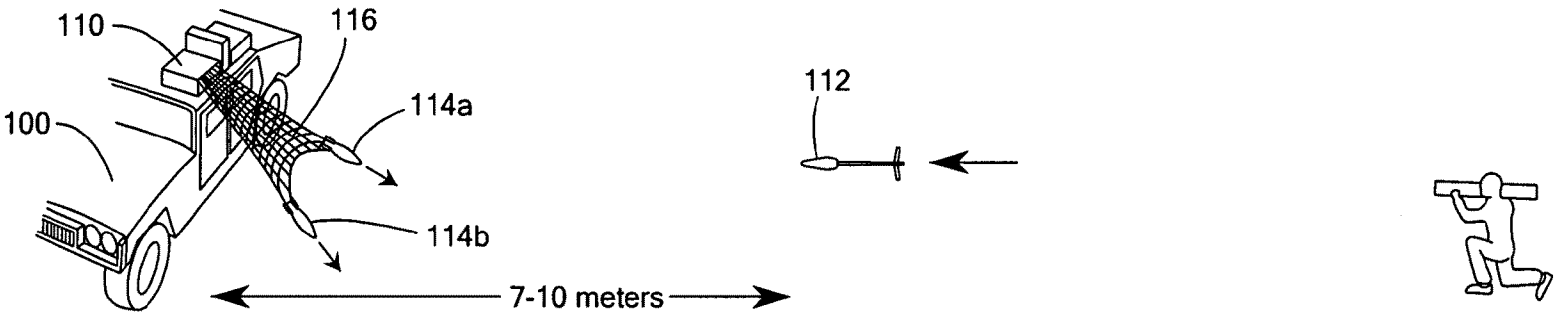
Figure 10C:
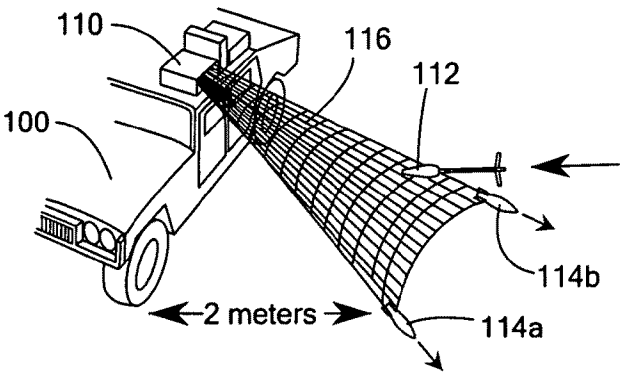
Figure 10D:
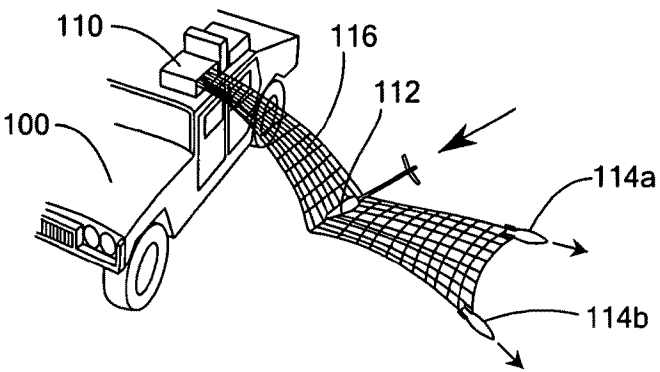
Figure 10E:
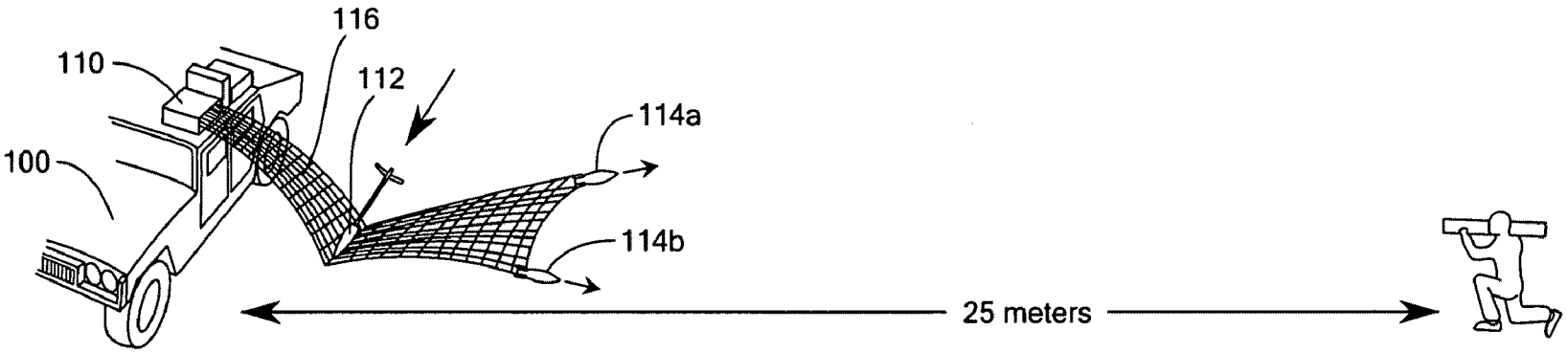

In still another example, the roof of vehicle 100, FIG. 10A is equipped with deployment box 110 having a packaged net and tractor thruster rockets tied to the bottom corners of the net packaged therein. The top of the net is fixed to the deployment box or vehicle. Upon detection of RPG 112, rockets 114*a* and 114*b* are fired to deploy net 116, FIGS. 10B-10C. In FIG. 10D, RPG 112 has struck net 116 and RPG 112 has been dudded. In FIG. 10E, RPG 112 has been diverted sideways and groundward.

Figure 11:
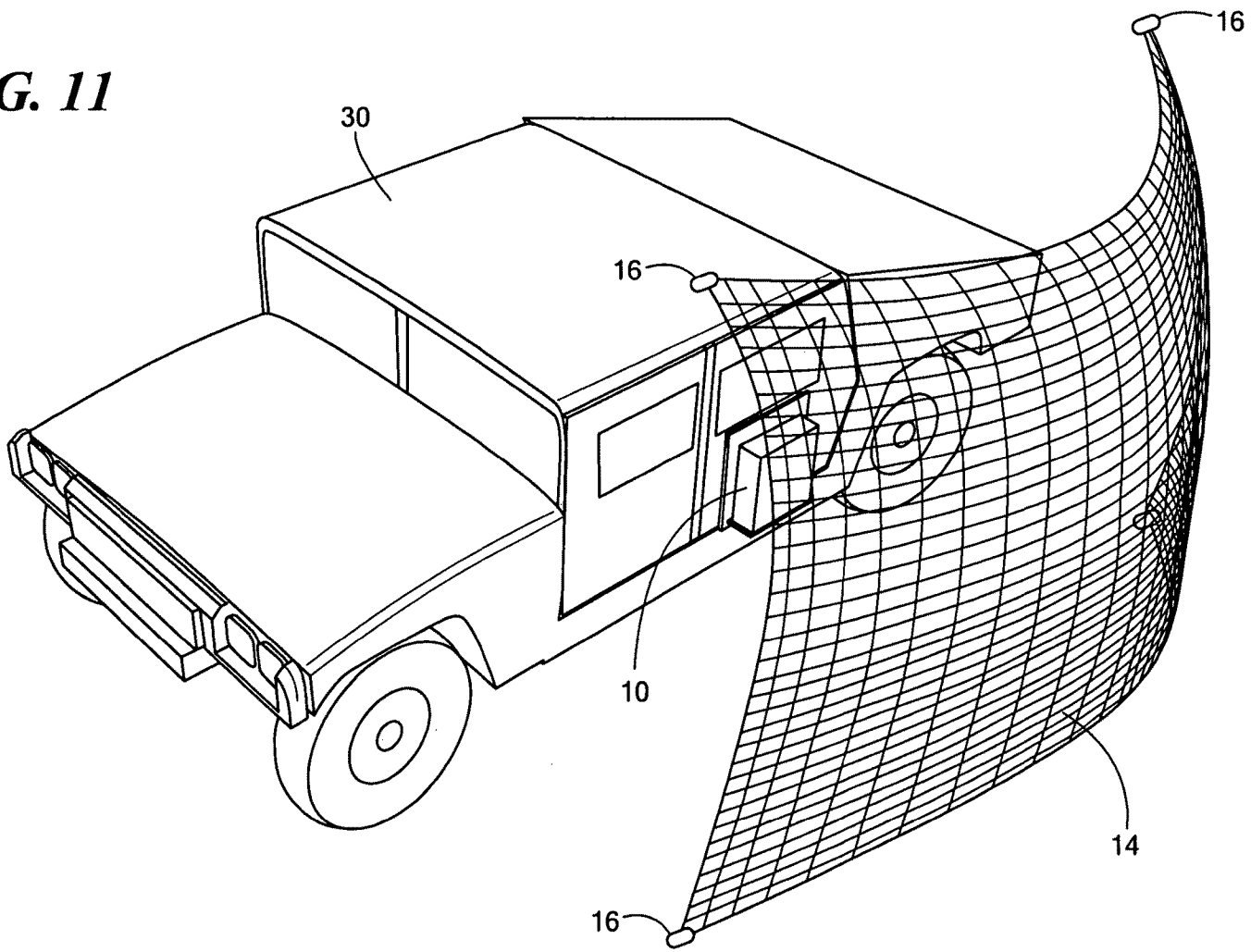
FIG. 11 is a schematic conceptual view of the system shown in FIGS. 1-3.
Figure 12:
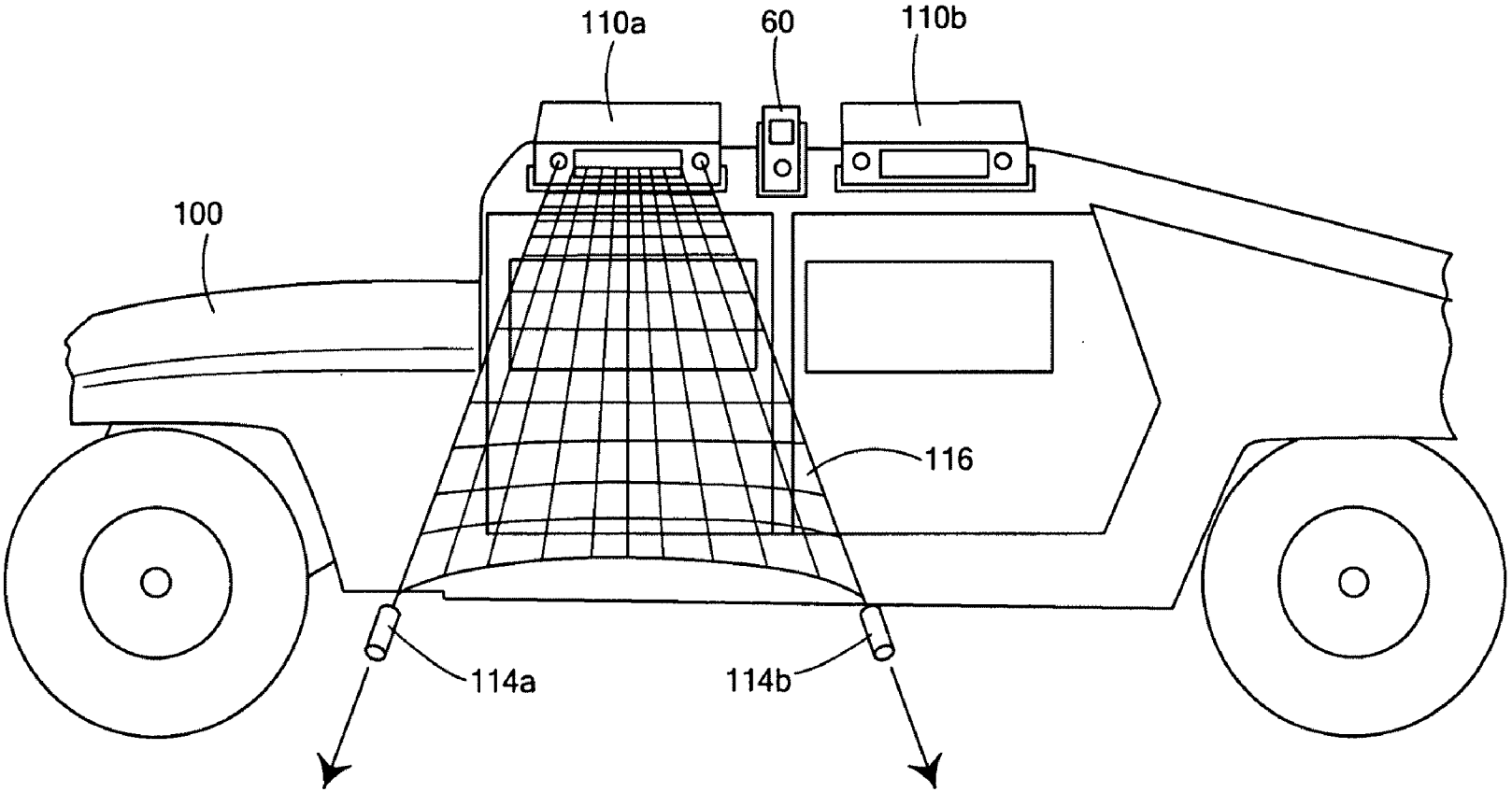
FIG. 12 is a schematic conceptual view of the system shown in FIG. 10.

FIG. 11 again shows a system described above with respect to FIGS. 1-4 with deployment box 10 attached to a door of military vehicle 30 and net 14 deployed. FIG. 12 again shows a system described above with respect to FIG. 10 with deployment boxes 110*a* and 110*b* located on the roof of military vehicle 110 and net 116 deployed from box 110*a* via rockets 114*a* and 114*b*. Sensor subsystem 60 (see FIG. 7) is also located on the roof of vehicle 100.

Figure 13:
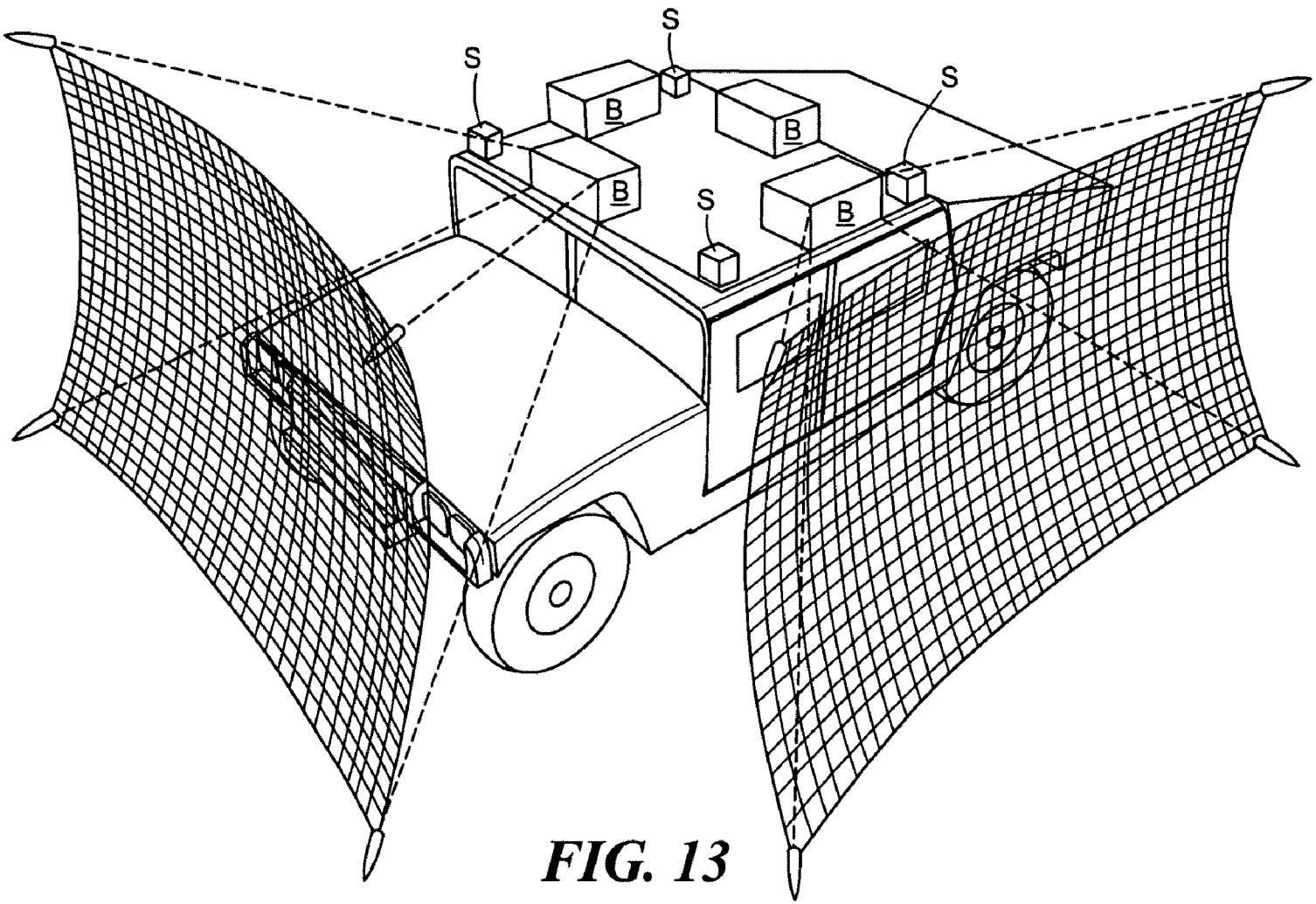
FIG. 13 is another schematic conceptual view of the system shown in FIG. 10.

FIG. 13 shows how full vehicle coverage can be provided by deployment boxes B located on the roof of a military vehicle an in combination with sensor subsystems S.

Figure 14:
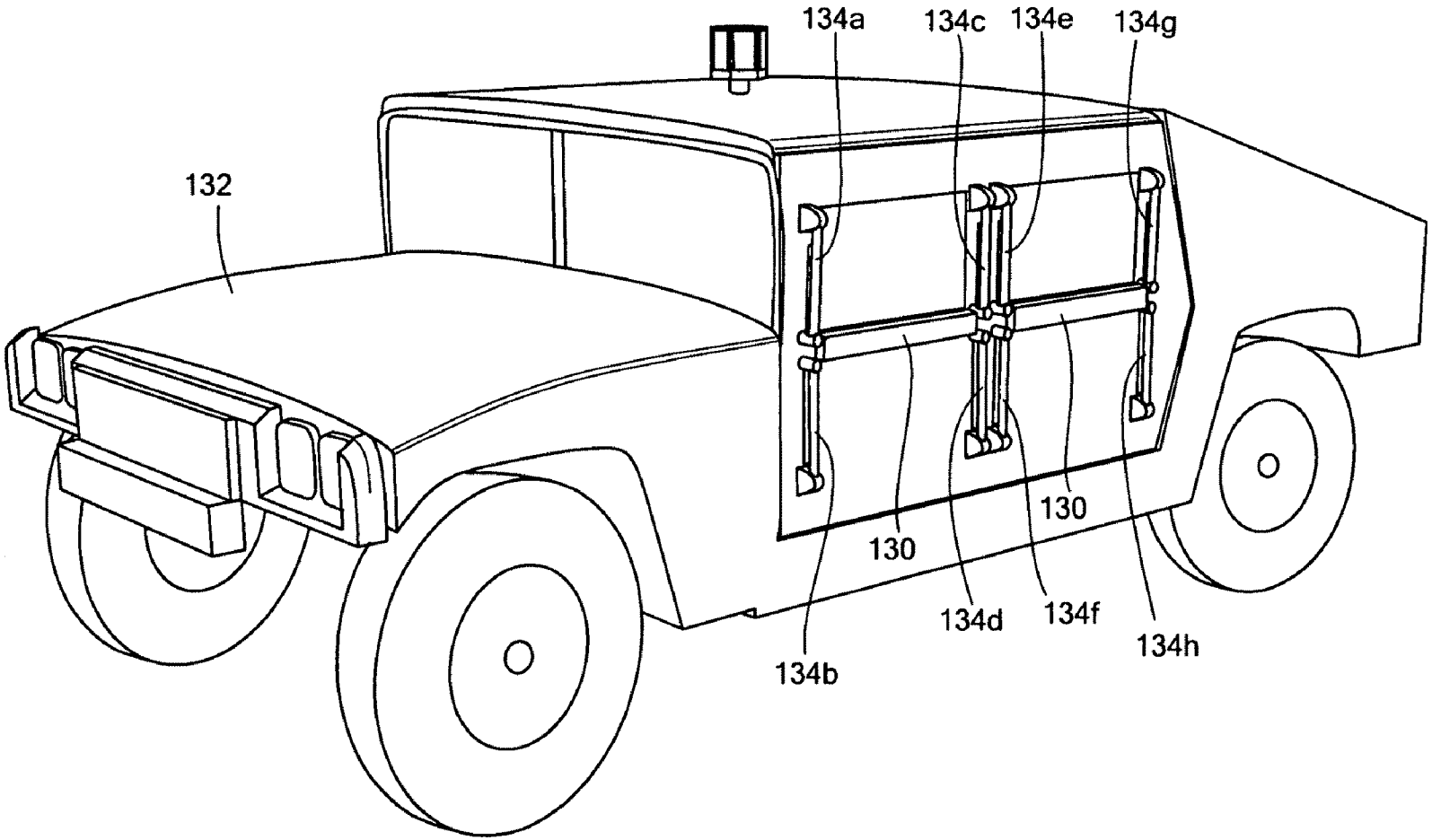
FIGS. 14-15 are schematic three-dimensional conceptual views of a protection system in accordance with this invention where actuator members are used to deploy a net.
Figure 15:
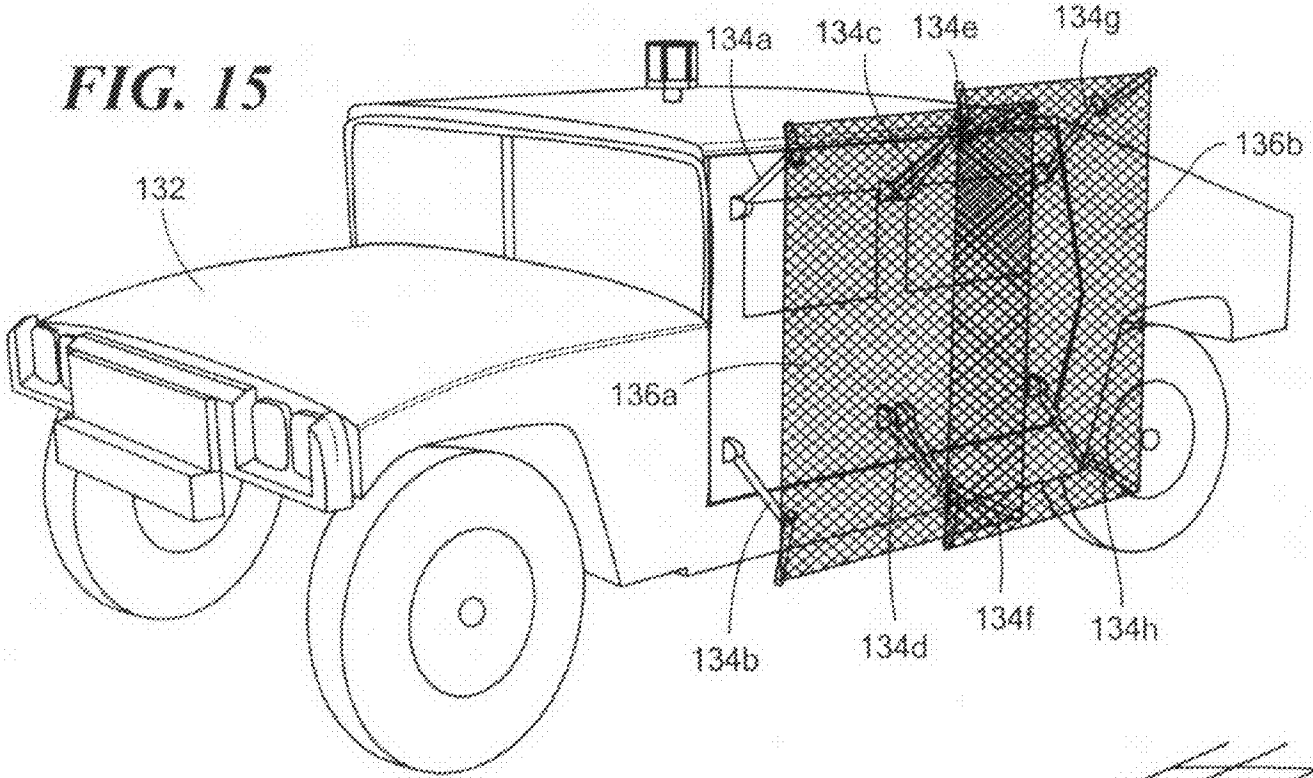

FIGS. 14-15 show another type of deployment box 130 housing a net and attached to vehicle 132. In this embodiment, the deployment subsystem includes actuators 134*a-g* configured to deploy nets 136*a* and 136*b*, FIG. 15. In one preferred embodiment, the actuators are spring loaded to deploy the net as shown when the actuators are mechanically released. The foldable members of commonly owned U.S. Pat. No. 6,374,565, hereby incorporated herein by this reference, may be included in the actuators 134*a-g*.

Figure 16:
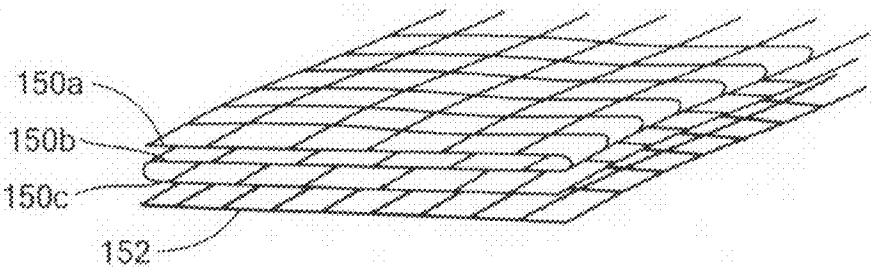
FIG. 16 is a schematic view of one preferred embodiment of a net system in accordance with this invention.

The preferred configuration of a net in any embodiment is shown in FIG. 16 where a small diameter line net is folded to form a plurality, for example, two to four (typically three) layers or plies 150*a*, 150*b*, 150*c* laid over a single layer or ply of a larger diameter line net 152.

The plies 150*a*-150*b* of net material include lines of PBO material 0.9 mm diameter (braided, 4 ply, 35 mm mesh) and the larger diameter line net 152 includes 3 mm diameter lines of PBO material (braided, 28 ply, 45-55 mm mesh).

It was found in testing that folds of the smaller line diameter net, in some cases, was sometimes pierced by a munition without duding. Adding additional layers or plies would sometimes result in the munition detonating on the net. A single layer larger diameter line net could also result in the munition detonating upon striking the net. But, surprisingly, when three layers of the smaller line diameter net were added in front of a single layer of the larger diameter line net, the munition did not pierce the net, did not detonate upon striking the net, and was successfully duded. It is believed this net system works well because the smaller diameter line net layers affects the response of the piezo charge generator of the munition and, when the munition then strikes the larger diameter line net, it disarms the net as explained above with reference to FIGS. 5-6 and/or the piezo charge generator, affected by the smaller line diameter net layers, is unable to generate a sufficient charge to detonate the munition. Also, it appears the smaller line diameter net directs a hole in the larger diameter line net to the munition nose and carries with it the smaller line diameter net plies to move successfully dud the munition.

In any embodiment, the result is a more effective and reliable protection system which is fairly simple in design and easy to install and which can also be manufactured fairly inexpensively. Protection is effected by a shield typically deployable or deployed outward from a vehicle or other structure when an incoming RPG or other threat is detected. The shield is designed primarily to disarm the threat instead of deflect or intercept and destroy it.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A structure or vehicle protection system comprising:

a frame on a structure or vehicle on one or more of its sides, front, rear, or roof, the frame defining a periphery; and a lightweight net within the periphery of the frame and spaced 8-48 inches from the structure or vehicle and having a mesh size configured to dud an RPG-7, RPG-7M, and/or RPG-18, the net made of synthetic line 0.5-3 mm in diameter forming meshes 30-60 mm in size.

2. The system of claim 1 in which the net has a knotless weave.

3. The system of claim 1 in which the net is made of PBO material.

4. The system of claim 1 in which there are two or more nets on the frame.

5. The system of claim 1 in which the net includes at least a first layer of smaller diameter line material and a layer of larger diameter line material.

6. The system of claim 5 in which there are between 2-4 layers of smaller diameter line material over a single layer of larger diameter line material.

7. A protection system for a an RPG having a nose diameter less than its body diameter, the system comprising:

a mobile vehicle;

a frame attached to the vehicle; and a net made of line within the frame spaced from the vehicle and having a mesh size between a nose diameter and a body diameter of an RPG-7, RPG-7M, and/or RPG-18 and configured to disarm the RPG by crushing its nose.

8. The system of claim 7 in which the net includes at least a first layer of smaller diameter line material and a layer of larger diameter line material.

9. The system of claim 7 in which there are between 2-4 layers of smaller diameter line material over a single layer of larger diameter line material.

* * * * *